US009953783B2

(12) United States Patent
Fellmer et al.

(10) Patent No.: US 9,953,783 B2
(45) Date of Patent: Apr. 24, 2018

(54) FUSE HAVING AN EXPLOSION CHAMBER

(71) Applicant: Lisa Draexlmaier GmbH, Vilsbiburg (DE)

(72) Inventors: Marko Fellmer, Vilsheim (DE); Christian Gruber, Bodenkirchen (DE); Peter Faltermeier, Landshut (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/154,901

(22) Filed: May 13, 2016

(65) Prior Publication Data

US 2016/0336131 A1 Nov. 17, 2016

(30) Foreign Application Priority Data

May 13, 2015 (DE) ..... 10 2015 107 579

(51) Int. Cl.
*H01H 39/00* (2006.01)
*H01H 33/18* (2006.01)
(Continued)

(52) U.S. Cl.
CPC ..... *H01H 39/006* (2013.01); *H01H 33/182* (2013.01); *H01H 9/34* (2013.01); *H01H 9/443* (2013.01)

(58) Field of Classification Search
CPC .... H01H 33/182; H01H 39/006; H01H 9/443; H01H 9/34
(Continued)

(56) References Cited

U.S. PATENT DOCUMENTS 3,848,100 A * 11/1974 Kozorezov ..... H01H 39/006 200/61.08
3,873,786 A * 3/1975 Lagofun ..... B23D 15/145 200/61.08
(Continued)

FOREIGN PATENT DOCUMENTS

DE 10 2004 010 746 A1 12/2004
DE 20 2006 016 171 U1 12/2006
DE 10 2007 051 504 A1 4/2009

OTHER PUBLICATIONS

German Office Action in German application DE 10 2015 107 579 2, dated Dec. 14, 2015.
(Continued)

*Primary Examiner* — Anatoly Vortman
(74) *Attorney, Agent, or Firm* — Finnegan, Henderson, Farabow, Garrett & Dunner LLP

(57) ABSTRACT

Embodiments disclose a fuse comprising a one power lead, an explosion chamber and an isolating chamber, wherein the fuse is designed such that a power lead can be broken into at least two parts by an explosion triggered in an explosion chamber. The two parts are separated from each other in an associated isolating chamber by a respective electrically insulating partition. Embodiments disclose a method comprising a power lead, an explosion chamber and an isolating chamber, wherein an explosion is triggered in the explosion chamber so that the power lead is broken into at least two parts and bent into the isolating chamber such that at least two parts are separated from one another by an electrically insulating partition. The present disclosure can be applied to pyrotechnic fuses for vehicles and to high-voltage fuses.

9 Claims, 5 Drawing Sheets

(51) Int. Cl.
*H01H 9/34* (2006.01)
*H01H 9/44* (2006.01)

(58) Field of Classification Search
USPC ..... 337/401
See application file for complete search history.

(56) References Cited

U.S. PATENT DOCUMENTS 4,224,487 A * 9/1980 Simonsen ..... H01H 39/006 200/61.08
4,311,890 A * 1/1982 Schroder ..... H01H 39/006 200/61.08
4,417,519 A * 11/1983 Lutz ..... F42C 19/06 102/263
5,535,842 A * 7/1996 Richter ..... B60K 28/14 180/271
5,793,275 A * 8/1998 Iversen ..... H01H 85/055 337/273
5,877,563 A * 3/1999 Krappel ..... H01H 39/006 180/271
6,194,988 B1 * 2/2001 Yamaguchi ..... H01H 39/006 180/279
6,222,439 B1 * 4/2001 Tanigawa ..... H01H 39/006 180/279
6,232,568 B1 * 5/2001 Hasegawa ..... H01H 39/006 200/61.08
6,295,930 B1 * 10/2001 Kume ..... H01H 39/006 102/202.5
6,946,608 B2 * 9/2005 Brede ..... H01H 39/006 180/271
7,078,635 B2 * 7/2006 Kordel ..... H01H 39/006 200/61.08
7,498,923 B2 * 3/2009 Iversen ..... H01H 39/006 200/61.08
7,511,600 B2 * 3/2009 Von Behr ..... H01H 39/006 200/61.08
8,432,246 B2 * 4/2013 Suzuki ..... H01H 9/12 200/61.08
8,957,335 B2 * 2/2015 Sprenger ..... B23D 15/145 200/61.04
9,153,402 B2 * 10/2015 Ukon ..... H01H 39/006
9,324,522 B2 * 4/2016 Nakamura ..... H01H 39/006
9,425,010 B2 * 8/2016 Hentschel ..... H01H 39/006
9,704,681 B2 * 7/2017 Fukuyama ..... H01H 39/006
2004/0041682 A1 * 3/2004 Pasha ..... H01H 39/006 337/401
2005/0034595 A1 2/2005 Kordel et al.
2005/0083164 A1 * 4/2005 Caruso ..... H01H 39/006 337/157

OTHER PUBLICATIONS

Decision to Grant in German application DE 10 2015 107 579 2, dated Apr. 19, 2016.

* cited by examiner

FUSE HAVING AN EXPLOSION CHAMBER

CROSS REFERENCE TO RELATED APPLICATION

This application is based upon and claims the benefit of prior German Patent Application No. 10 2015 107 579.2, filed on May 13, 2015, the entire contents of which are incorporated herein by reference.

TECHNICAL FIELD

The present disclosure relates to a fuse, comprising at least one power lead and at least one explosion chamber, wherein the fuse is designed such that the at least one power lead can be separated into at least two parts when an explosion is triggered in at least one explosion chamber. The present disclosure also relates to a method for operating a fuse comprising at least one power lead and one explosion chamber, wherein an explosion is triggered in the explosion chamber so that the at least one power lead is separated into at least two parts. The present disclosure can be applied to pyrotechnic fuses for vehicles, in particular motor vehicles. The present disclosure can also be applied to high-voltage fuses.

BACKGROUND OF THE DISCLOSURE

At high voltages, the problem arises that, after a power lead has been cut, an arc may occur between the two separated parts. The arc can be extinguished by adding a fluid acting in an electrically insulating manner, such as an oil, a gel or a gas; this, however, is very complex.

DE 10 2007 051 504 A1 discloses a safety device for interrupting a current conductor, comprising an ignition chamber, in which an isolating body on which a propellant charge can act is disposed in such a way that the isolating body, on being triggered, migrates into a collection chamber, cutting the current-carrying conductor. This safety device, however, includes a variety of drawbacks. For example, the safety device does not suppress a developing arc.

DE 10 2004 010 746 A1 discloses a pyromechanical isolating device comprising a conductor rail that can be cut at an isolating point by an isolating tool, wherein the isolating tool can be accelerated by propellant gases of a propellant charge. The isolating device also fails to suppress a developing arc.

DE 20 2006 016 171 U1 discloses a corresponding safety device for isolating an electrical conductor by way of a pressure wave and using a wedge made of an electrically non-conducting material, wherein the fixed wedge and the propellant charge for generating the pressure wave are disposed on opposing sides of the electrical conductor.

SUMMARY

Embodiments of the present disclosure provide a simple, reliable and cost-effective option for preventing an arc to develop between isolated electrical parts of a current conductor in a fuse, or to cause an arc that has developed to be extinguished. The present disclosure can be applied to high-voltage fuses.

Embodiments of the present disclosure provide a fuse, comprising at least one power lead, at least one explosion chamber and at least one chamber (hereafter also referred to as an "isolating chamber"), wherein the fuse is designed such that at least one power lead can be separated into at least two parts by the triggering of an explosion in at least one explosion chamber, and the separated parts are separated from each other in a respective associated isolating chamber by a respective electrically insulating partition.

In embodiments of the present disclosure, very rapid tripping of the fuse may be achieved by the triggering of the explosion in the explosion chamber and a corresponding rise in pressure. The fuse may also provide sufficiently high energy to mechanically separate even thicker current conductors for high-voltage and/or high-current lines in a reliable manner. Since the separated parts (after the fuse has been tripped) are separated from each other by the partition and no arc can form through the partition, a shortest distance between the two separated parts may be increased so that it is too long for an arc to form or be maintained. To this end, no electrically insulating fluid may be added. This fuse may have a compact and cost-effective design. In addition, losses of power can be minimized.

Hereafter, when "one" or "the" power lead, explosion chamber, isolating chamber, partition and the like are mentioned, this shall be understood to mean "at least one" such component, except when this is explicitly excluded, such as by the expression "exactly one." The expression "at least one" covers the cases of "exactly one" and "multiple."

The fuse can also be referred to as a pyrotechnic fuse or "pyrofuse."

According to an embodiment, at least one power lead is a conductor rail, so that the fuse is configured for high-current and/or high-voltage applications. The conductor rail can have a ribbon-like basic shape. The power lead can be metallic or made of metal, and may be coated or uncoated.

According to an embodiment, the explosion chamber comprises at least one pyrotechnic blasting charge, which can be triggered electrically and/or thermally, thereby causing the explosion. The blasting charge may comprise or be a squib. The blasting charge can be electrically ignited. The blasting charge can be generated by an external triggering device. As an alternative or in addition, the blasting charge can be generated by a triggering device that represents part of the fuse or is integrated into the fuse.

The partition can be made of non-flammable plastic material or of ceramic material, for example.

According to an embodiment, at least one isolating element for isolating the power lead can be pressed onto the power lead by the triggering of the explosion. Typically, the pressure of the isolating element initially bends the metallic power lead. As the isolating element continues to move, the bend of the conductor rail increases until the yield point is reached or exceeded, for example in the contact region with the isolating element, and the conductor rail separates or tears into two parts.

According to an embodiment, the isolating element may be designed as the electrically insulating partition. As the isolating element continues to move after isolating the power lead, the element slides between the two separated parts and then serves as the partition.

According to an embodiment, the isolating element comprises a sealing plate serving or designed as a displaceable wall of the explosion chamber, an isolating web protruding from the sealing plate in the direction of the power lead, and the isolating chamber being disposed on the side facing away from the isolating element and positioned so that the isolating web can be disposed between the separated parts. The sealing plate may enable energy of the explosion in the explosion chamber to be directly converted into a movement of the sealing plate, and therefore a movement of the isolating web, which may provide a rapidly tripping and compact fuse. By virtue of the sufficient depth of the isolating chamber, the isolating web can slide reliably between the separated ends of the two separated parts and may thereby reliably prevent or extinguish the arc.

The isolating web can have a blade-like or dull design on the edge or rim facing the power lead ("separating edge").

According to an embodiment, to prevent a rotation or tilting of the sealing plate in the event of an explosion, the sealing plate can be guided in a linear displaceable manner. For example, a housing of the fuse can comprise one or multiple guide rails and/or longitudinal grooves, which can be engaged with corresponding recesses or protrusions of the sealing plate. The sealing plate can consequently be guided in the housing in a linearly displaceable manner, in a direction perpendicular to the power lead.

According to an embodiment, the power lead comprises at least one predetermined breaking point so that an isolation point of the two separated parts can be precisely determined.

According to an embodiment, the power lead may represent a wall of the explosion chamber, and the isolating chamber comprises an electrically insulating partition that is oriented in the direction of the power lead. In this way, a linearly movable isolating element may be dispensed with, allowing a simplified and robust design. The conductor rail can be separated into two parts solely by being expanded sufficiently after the explosion that it tears. Under the impact of the explosion, the separated parts are reliably deformed into the isolating chamber on different sides of the partition, which may bring about a suppression of an arc.

According to an embodiment, the power lead may have a predetermined breaking point, and the isolating chamber, beneath the predetermined breaking point, comprises the electrically insulating partition that is oriented in the direction of the power lead. The predetermined breaking point may be located above the partition. The separated parts may tear above the partition and therefore, when the fuse has been tripped, are located next to the partition.

According to an embodiment of the present disclosure, the partition may be spaced from the power lead. A reliable isolation of the current conductor may be achieved because the conductor rail can undergo a sufficiently large expansion for separation before it reaches the height of the partition. If the current conductor were to impinge on the partition prior to being separated, this could possibly impede, or even completely prevent, the deformation thereof, and thus the separation.

According to an embodiment of the present disclosure, each power lead can be separated into exactly two parts, and the fuse comprises exactly one partition per power lead. Such a fuse can be isolated quickly and reliably.

According to an embodiment of the present disclosure, the fuse comprises exactly one partition per power lead.

According to an embodiment of the present disclosure, the fuse can comprise multiple individual fuses that can be actuated independently of one another, and possibly even tripped independently of one another (for example, each including exactly one power lead and exactly one isolating element or one partition), for example in the form of a group of fuses or a fuse array.

According to an embodiment of the present disclosure, the fuse comprises at least one extinguishing magnet (also referred to as "arc blow-out magnet"). An extinguishing magnet shall be understood to mean a magnet that is configured and disposed to provide a magnetic field in an area of the fuse in which an arc could form. The magnetic field causes a path taken by an arc to be curved, whereby the shortest distance between the two parts of the isolated power lead is extended. The extinguishing magnet can thus be used to support a prevention or suppression of an arc. For example, the magnetic field generated by the extinguishing magnet can be generated with notable strength at the site where the power lead is not bent yet and/or in the isolating chamber.

The fuse can protect a current flow at an isolating current of at least 7500 A at 450 VDC to 1500 VDC without effect on the surrounding area. The fuse may be a high-voltage fuse or a "high-voltage pyrofuse."

According to an embodiment of the present disclosure, the fuse can comprise a housing from which end regions of a respective power lead protrude as electrical connections. For example, the housing can be made of electrically insulating and non-flammable plastic material or plastic material. The housing can have a cuboid basic shape. An extinguishing magnet, if present, can be recessed in the housing.

Embodiments of the present disclosure provide a method for operating a fuse, comprising at least one power lead, at least one explosion chamber and at least one isolating chamber, wherein an explosion is triggered in the explosion chamber so that the at least one power lead is separated into at least two parts and thereby bent into the isolating chamber such that at least two separated parts in the isolating chamber are separated from one another by an electrically insulating partition.

According to embodiments of the present disclosure, an explosion is triggered in the explosion chamber so that a power lead serving as a wall of the explosion chamber is deformed (for example, stretched) by pressure application for separation thereof at a predetermined breaking point, and parts of the conductor rail separated at the predetermined breaking point are bent toward different sides of a partition located in the isolating chamber.

According to an embodiment, an explosion is triggered in the explosion chamber so that an isolating element is moved by pressure application, which is pressed onto the power lead so as to isolate the power lead, and the isolating element continues to be moved in the isolating chamber, after separating the power lead, until it is disposed between the separated parts of the power lead.

The properties, features and advantages of the present disclosure as described, and the manner in which these are achieved, will become more apparent and understandable in connection with the following detailed description, which will be described in more detail in connection with the drawings. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
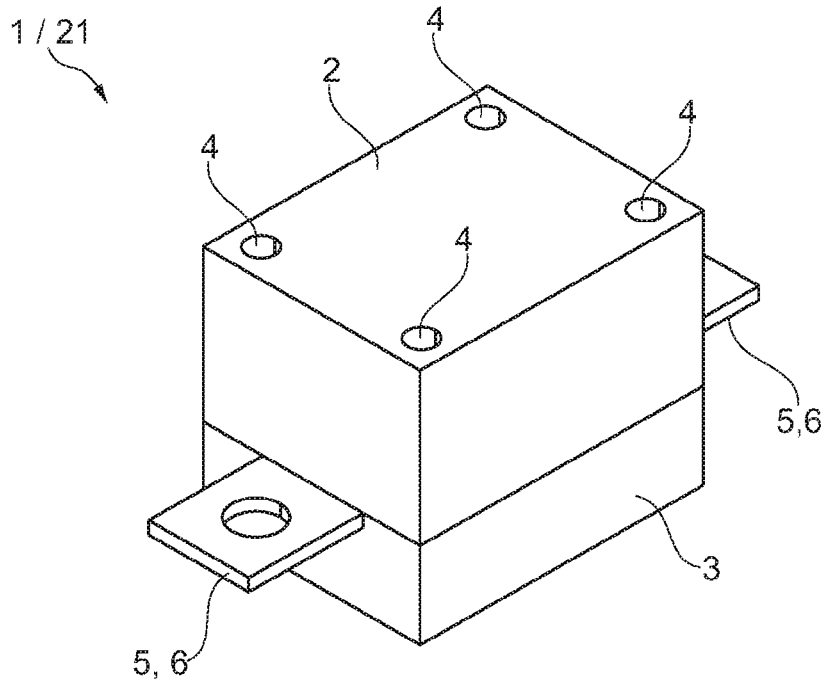
FIG. 1 shows an oblique view of a pyrotechnic fuse according to an exemplary embodiment.

FIG. 1 shows an oblique view of an exemplary pyrotechnic fuse 1 comprising a first "top" housing part 2 and a second "bottom" housing part 3. The two housing parts 2 and 3 have aligned boreholes 4 through which the two housing parts 2 and 3 can be fixedly connected, for example screwed, to each other. The housing 2, 3 assembled from the two housing parts 2 and 3 can be made of electrically insulating plastic material, for example. End regions of a power lead protrude from the housing 2, 3 in the form of a metallic conductor rail 5 as electrical connections 6.

The fuse 1 can protect a current flow at an isolating current of at least 7500 A at 450 volts direct current (VDC) to 1500 volts direct current without effect on the surrounding area. The fuse 1 may be a high-voltage fuse or a "high-voltage pyrofuse."

The housing 2, 3 can have a cuboid basic shape. An extinguishing magnet (not shown), if present, can be recessed in the housing 2, 3.

Figure 2:
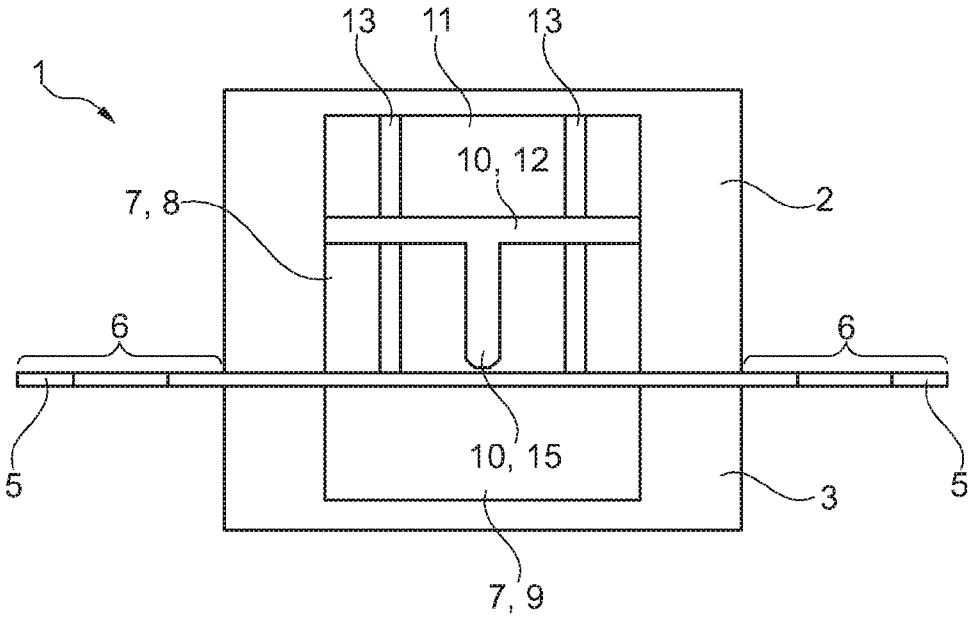
FIG. 2 shows a sectional illustration of a side view of the pyrotechnic fuse in a non-tripped state according to an exemplary embodiment.

As is shown in FIG. 2, the housing 2, 3 comprises a sealed interior 7, which is divided by the conductor rail 5 into a top sub-chamber 8 and a bottom sub-chamber 9 serving as the "isolating chamber." An isolating element 10, which forms an explosion chamber 11 in the top sub-chamber 8, is located in the top sub-chamber 8. The isolating element 10 may be made of non-flammable, electrically insulating plastic material or of electrically insulating ceramic material, for example.

Figure 3:
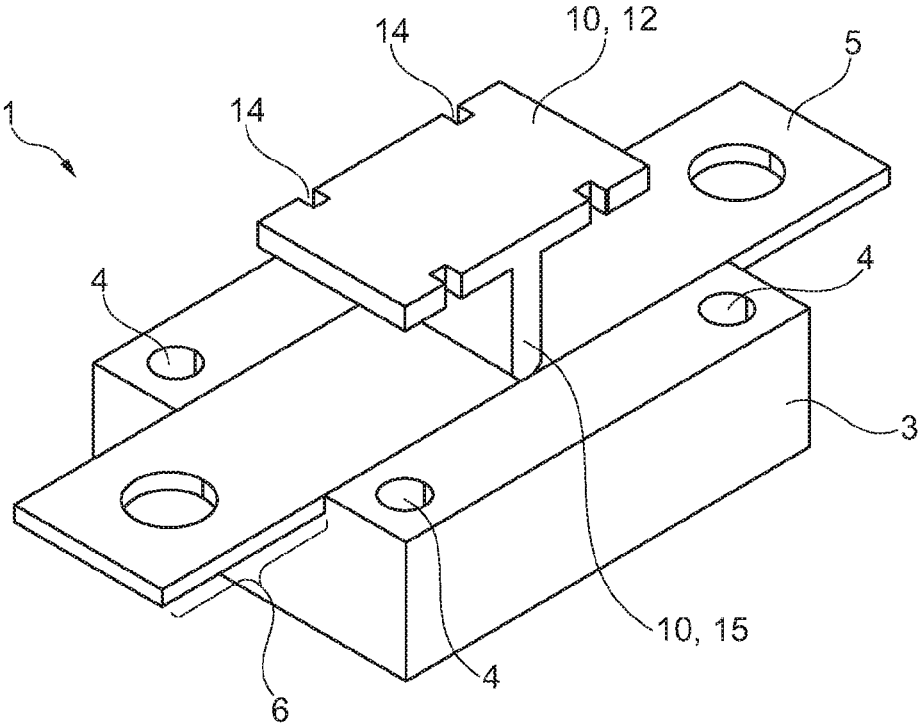
FIG. 3 shows an oblique view of parts of the pyrotechnic fuse in the non-tripped state according to an exemplary embodiment.

The isolating element 10 comprises a sealing plate 12 serving as a displaceable wall of the explosion chamber 11, as also shown in the removed first housing part 2 in FIG. 3. The sealing plate 12 is mounted in the first housing part 2 so as to be linearly displaceable in a direction perpendicular to the longitudinal extension of the conductor rail 5. For this purpose, the first housing part 2 comprises guide rails 13 on opposing sides of the top sub-chamber, which extend perpendicularly to the conductor rail 5 (shown in FIG. 2 as from top to bottom). The guide rails 13 engage in corresponding recesses 14 in the sealing plate 12.

The isolating element 10 furthermore comprises an isolating web 15 that protrudes beyond or away from the sealing plate 12, perpendicularly in the direction of the conductor rail 5. The sealing plate 12, isolating web 15, and the isolating element 10 may together have a T shape. The isolating web 15 may be seated on the conductor rail 5. The explosion chamber 11 is therefore delimited or formed by the top housing 2 and the sealing plate 12, and is located on the side of the sealing plate 12 facing away from the isolating web 15.

The explosion chamber 11 may be assigned a blasting charge that can be triggered in a defined or controlled manner (not shown). During explosion of the blasting charge a high overpressure builds in the explosion chamber 11 in a short time. For example, the blasting charge may be a squib that can be ignited by way of an electrical blasting cable (not shown). The fuse 1 may comprise a corresponding connection (not shown). The appropriate firing pulse can be generated by an external triggering device (not shown). However, the appropriate firing pulse can also be generated by a triggering device (not shown) that represents a part of the fuse 1.

Figure 4:
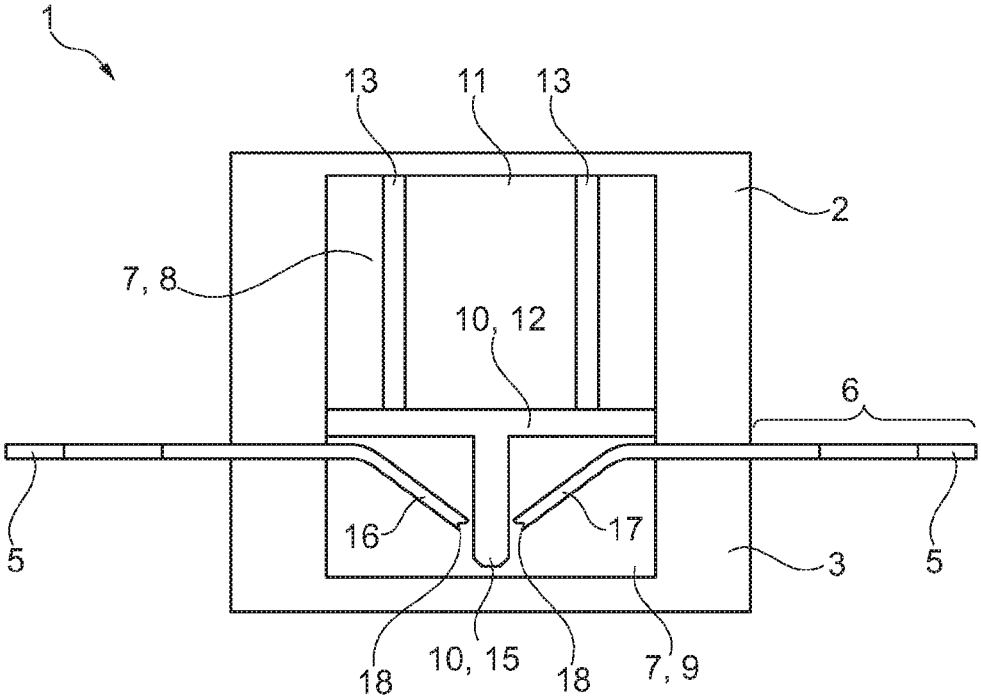
FIG. 4 shows a sectional illustration of a side view of the pyrotechnic fuse in a tripped state according to an exemplary embodiment.
Figure 5:
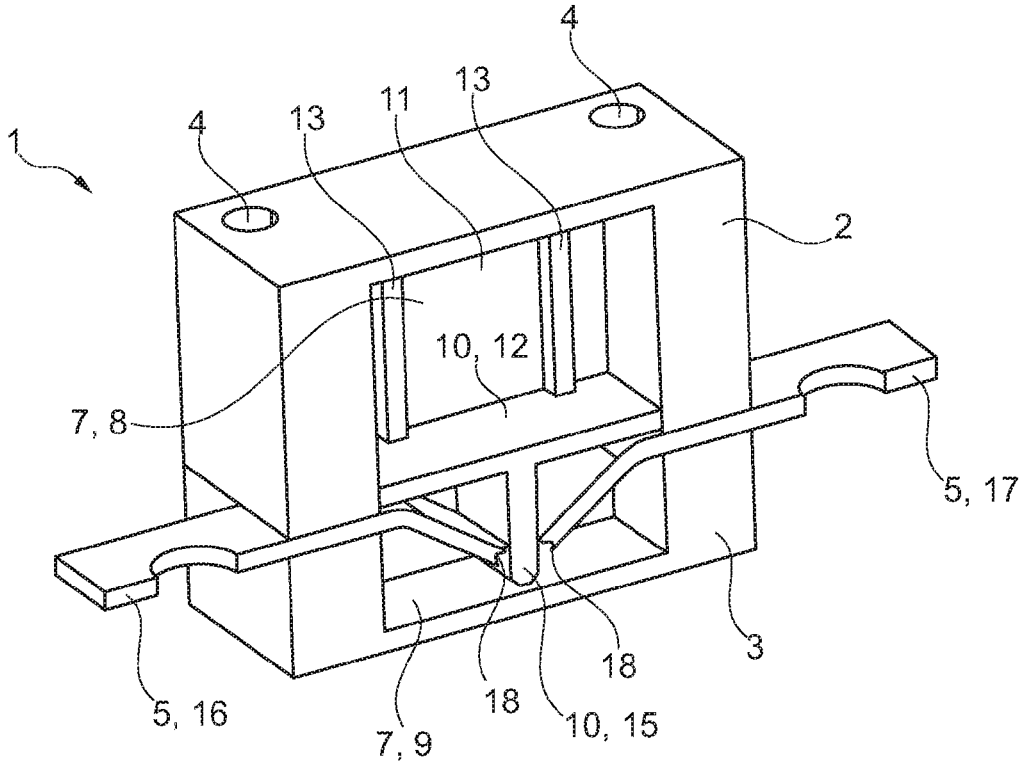
FIG. 5 shows a sectional illustration of an oblique view of the pyrotechnic fuse in the tripped state according to an exemplary embodiment.
Figure 6:
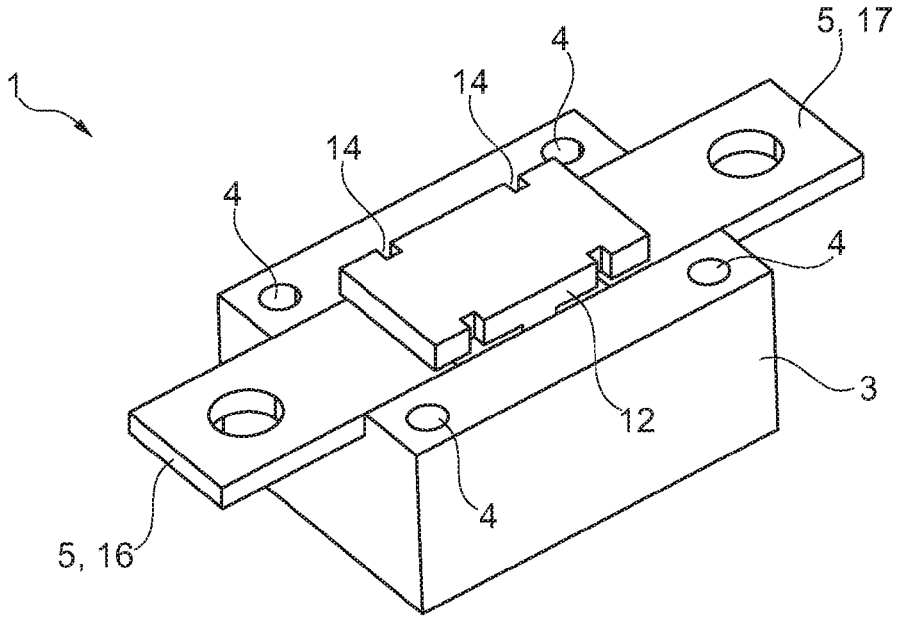
FIG. 6 shows an oblique view of the parts of the pyrotechnic fuse shown in FIG. 3 in the tripped state according to an exemplary embodiment.

The overpressure of the explosion exerts a force or a pulse on the sealing plate 12 in the direction of the conductor rail 5. This, in turn, presses the isolating web 15 on the conductor rail 5, which yields under the pressure of the isolating web 15 by deforming into the isolating chamber 9. The isolating web 15 presses the conductor rail 5 further and further into the isolating chamber 9 until the conductor rail 5 tears—typically at the contact surface with the isolating web 15—and consequently is separated into a first part 16 (shown on the left) and a second part 17 (shown on the right), as illustrated in FIG. 4, FIG. 5 and FIG. 6.

An overpressure that is still present in the explosion chamber 11 and/or the pulse thereof causes the isolating element 10 to continue to move in the direction of the isolating chamber 9, even after the conductor rail 5 has been separated, for example until the isolating web 15 strikes a bottom of the isolating chamber 9 and/or the sealing plate 12 strikes the conductor rail 5 and is stopped, whereby the fuse 1 assumes an end position. The isolating web 15 thus slides through a gap between the two separated parts 16 and 17 of the conductor rail 5 and is therefore disposed between the two separated parts 16 and 17. The isolating web 15 may serve as a partition between the two parts 16 and 17. For example, the isolating chamber 9 may be sufficiently deep in the direction of the movement of the isolating element 10 that the isolating web 15 can be reliably disposed between the two parts 16 and 17 in the end position. Isolating web 15 can be noticeably displaced beyond the separating edges 18 of the two parts 16 and 17. In the end position, the separated parts 16 and 17 of the conductor rail 5 are therefore separated from one another in the isolating chamber 9 by a respective electrically insulating partition in the form of the isolating web 15.

At the moment that the conductor rail 5 is separated into the two parts 16 and 17, an arc may develop between these, for example if a high voltage is present at the connections of the conductor rail. The arc extinguishes if a shortest distance between the two separating edges 18 grows larger than a predefined maximum distance. By the isolating web 15 sliding between the two separating edges 18, and by the isolating web 15 being electrically insulating, the distance between the two separating edges 18 (past the isolating web 15) can be reliably set such that it becomes larger than the maximum distance needed to maintain the arc. The arc may therefore be extinguished, and kept extinguished. The isolating web 15 is not damaged because it is not flammable. The explosion additionally achieves a rapid tripping of the fuse 1 and isolation of the conductor rail 5.

Figure 7:
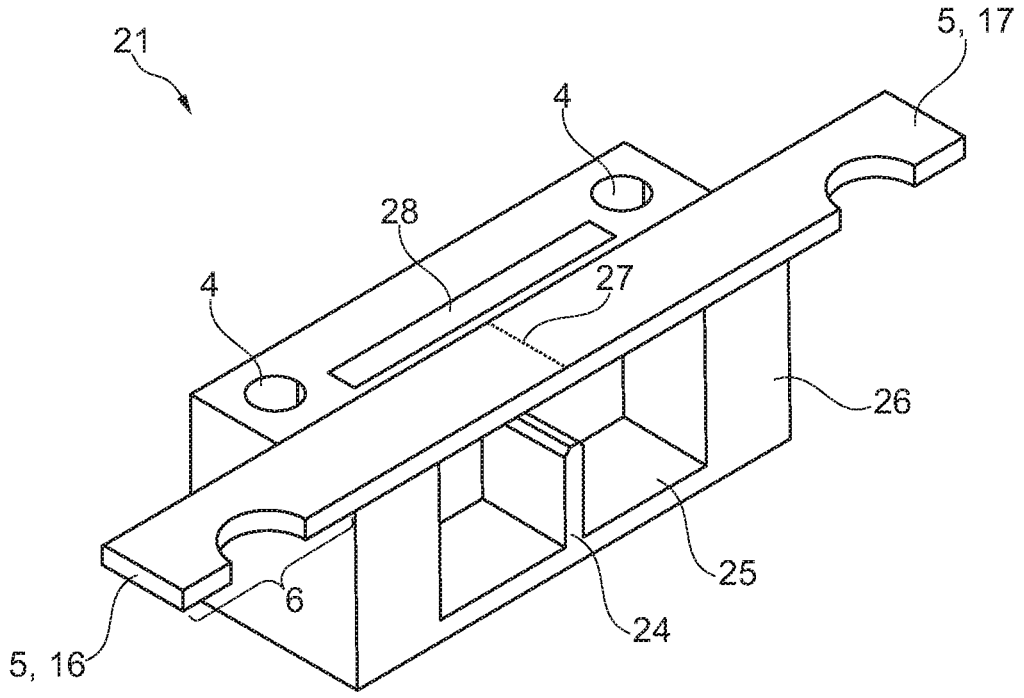
FIG. 7 shows a sectional illustration of an oblique view of parts of the pyrotechnic fuse in a non-tripped state according to an exemplary embodiment.
Figure 8:
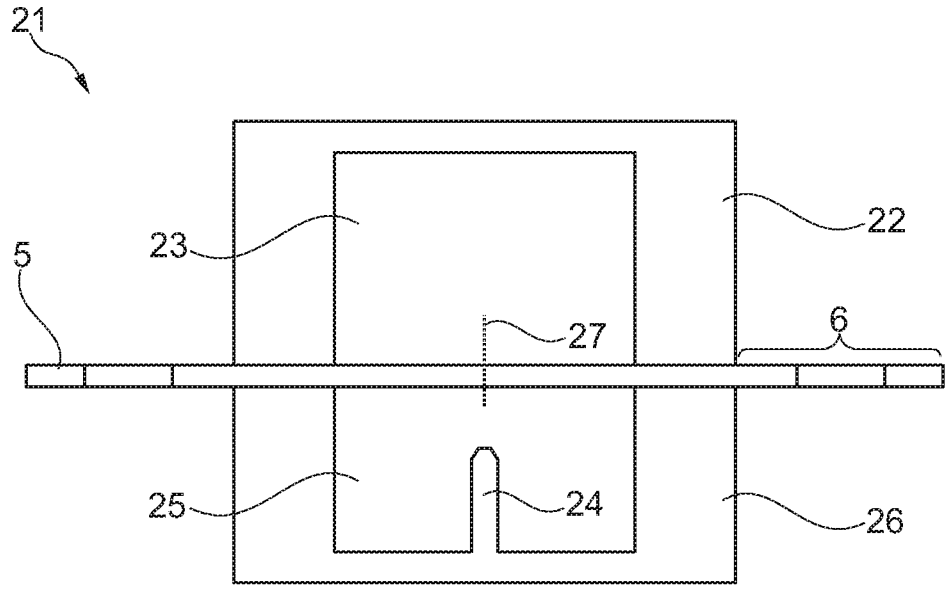
FIG. 8 shows a sectional illustration of a side view of the pyrotechnic fuse in the non-tripped state according to an exemplary embodiment.

FIG. 7 shows a sectional illustration of an oblique view of an exemplary pyrotechnic fuse 21 without the first housing part and in a non-tripped state. Externally, the fuse 21 can look like the fuse 1 as shown in FIG. 1. FIG. 8 shows a sectional illustration of a side view of the fuse 21.

The first housing part 22 of the fuse 21 can be designed similarly to the first housing part 2 of the fuse 1. Here, however, the first housing part 22 does not comprise any guide rails because no linearly displaceable isolating element is present in the top sub-chamber, which now serves entirely as the explosion chamber 23.

The isolating element used in the fuse 21 is designed as a partition 24, which protrudes from a bottom of an isolating chamber 25 in the direction of the conductor rail 5, and perpendicularly to the conductor rail 5. The partition 24 is spaced from the conductor rail 5. The partition 24 is made of non-flammable and electrically insulating plastic material or of an electrically insulating ceramic material, for example. The explosion chamber 23 is separated from the isolating chamber 25 only by the conductor rail 5 here. The isolating chamber 25 is consequently delimited by a second housing part 26 and the conductor rail 5, while the explosion chamber 23 is delimited by the first housing part and the conductor rail 5.

The conductor rail 5 may therefore represent a wall of the explosion chamber 23, which separates the explosion chamber 23 from the isolating chamber 25. Above the partition 24, the conductor rail 5 has a predetermined breaking point 27.

Figure 9:
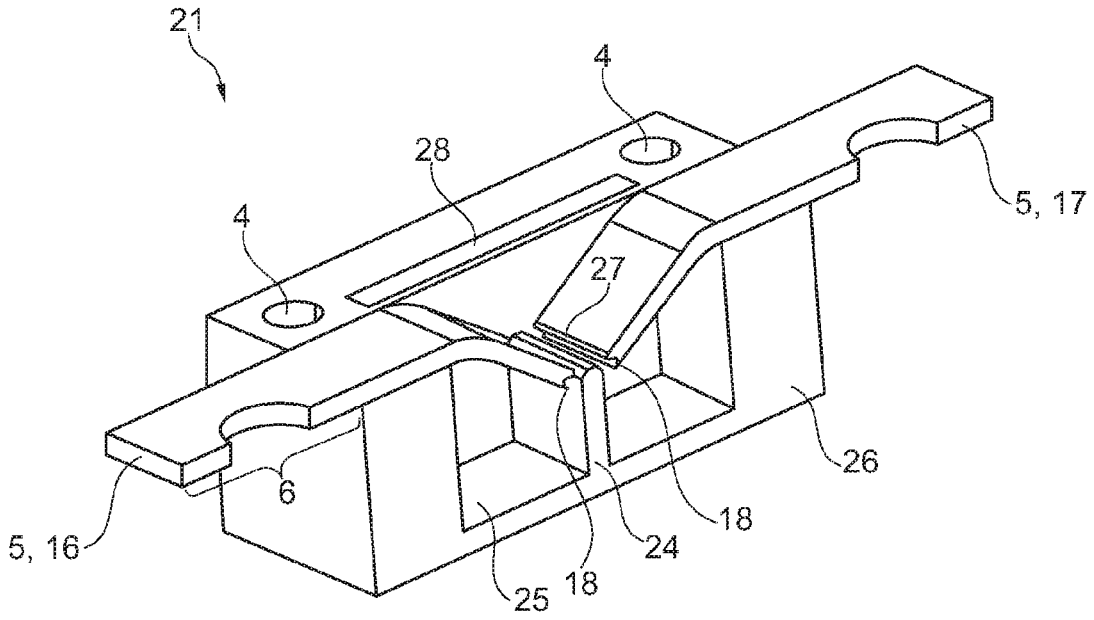
FIG. 9 shows a sectional illustration of an oblique view of parts of the pyrotechnic fuse in a tripped state according to an exemplary embodiment.

FIG. 9 shows the fuse 21 in a tripped state in a view analogous to that of FIG. 7. The tripped state is reached when an explosion is being triggered in the explosion chamber 23. The pressure created in the explosion chamber 23 causes the conductor rail 5 to be bent in the direction of the isolating chamber 25 that it is stretched sufficiently at the predetermined breaking point 27 to tear at that point. This separation into the parts 16 and 17 takes place prior to reaching the partition 24. The pulse of the two parts 16 and 17 causes these to be bent further into the isolating chamber 25, even after they have been separated, and sufficiently far that the separating edges 18 are separated by the partition 24. In this way, an arc can be quickly extinguished or a formation of an arc can be prevented, similar to the fuse 1.

The fuse 21 may comprise at least one arc blow-out or extinguishing magnet 28, which is recessed into the housing 22, 26 of the fuse 21 to the side of the conductor rail 5.

In some embodiments, the conductor rail 5 of the fuse 1 can also have a predetermined breaking point 27 in the contact region with the isolating web 15.

In some embodiments, the fuse 1 can also comprise at least one arc blow-out or extinguishing magnet 28, to the side of the conductor rail 5 and recessed into the housing 2 and 3. During operation, an arc can be deflected laterally relative to the conductor rail 5, for example, whereby the length of the conductor rail 5 is noticeably increased and the extinguishing of the arc is thereby supported and/or the generation of the arc is thereby suppressed.

In general, "a," "an" or the like may be understood to mean a singular or a plural form, in particular within the meaning of "at least one" or "one or more" or the like, unless this is explicitly excluded, such as by the expression "exactly one" or the like.

Numerical information can also comprise exactly the indicated number as well as a typical tolerance range, unless explicitly excluded.

While the present disclosure is illustrated and described in detail according to the above embodiments, the present disclosure is not limited to these embodiments and additional embodiments may be implemented. Further, other embodiments and various modifications will be apparent to those skilled in the art from consideration of the specification and practice of one or more embodiments disclosed herein, without departing from the scope of the present disclosure.

LIST OF REFERENCE NUMERALS

1 fus.
2 first housing part
3 second housing part
4 borehole
5 conductor rail
6 electrical connection
7 interior
8 top sub-chamber
9 isolating chamber
10 isolating element
11 explosion chamber
12 sealing plate
13 guide rail
14 recess
15 isolating element
16 first part of the conductor rail
17 second part of the conductor rail
18 separating edge
21 fuse
22 first housing part
23 explosion chamber
24 partition
25 isolating chamber
26 second housing part
27 predetermined breaking point
28 extinguishing magnet

What is claimed is:

1. A fuse for causing a break in a power lead, wherein the power lead has a predetermined breaking point along a length of the power lead, the fuse comprising:

an explosion chamber for triggering an explosion configured to cause a break in the power lead at the predetermined breaking point, the explosion chamber having first and second explosion chamber walls across which the power lead extends;

an isolating chamber having first and second isolating chamber walls across which the power lead extends, such that a fuse portion of the power lead extends between a first location of the first isolating chamber wall and a second location of the second isolating chamber wall, and wherein the fuse portion of the power lead includes the predetermined breaking point, and wherein the fuse portion of the power lead forms a wall that substantially isolates the isolating chamber from the explosion chamber prior to the explosion triggered in the explosion chamber; and an electrically insulating partition extending, from a bottom of the isolating chamber, toward the power lead, such that a distal end of the partition is spaced from the power lead;

wherein:

the power lead is configured to break into at least first and second parts at the predetermined breaking point by the explosion triggered in the explosion chamber, the first and second parts configured to bend at about the first and second locations, respectively, of the first and second isolating chamber walls, and the electrically insulating partition is configured to keep the first and second parts of the power lead electrically isolated from each other in the isolating chamber.

2. The fuse according to claim 1, wherein the electrically insulating partition is positioned within the isolating chamber.

3. The fuse according to claim 1, wherein the power lead is configured to break at only the predetermined breaking point into exactly two parts, and the fuse includes exactly one electrically insulating partition for the power lead.

4. The fuse according to claim 1, further comprising:

a magnet for providing a magnetic field configured to suppress formation of an arc between the first and second parts.

5. A method for operating a fuse comprising at least one power lead, an explosion chamber, and an isolating chamber having first and second isolating chamber walls across which the power lead extends, such that a fuse portion of the power lead extends between a first location of the first isolating chamber wall and a second location of the second isolating chamber wall, wherein the fuse portion of the power lead forms a wall that substantially isolates the isolating chamber from the explosion chamber prior to an explosion triggered in the explosion chamber, wherein the method comprises:

deforming the power lead by an application of pressure when the explosion is triggered in the explosion chamber;

separating the power lead into at least first and second parts at a predetermined breaking point;

bending each separated part at about the first and second locations, respectively, of the first and second isolating chamber walls towards a different side of an electrically insulating partition that extends from a bottom of the isolating chamber; and isolating the bent parts from each other by the partition, wherein a distal end of the partition is spaced from the power lead.

6. The method according to claim 5, wherein the electrically insulating partition is located in the isolating chamber.

7. A high-voltage pyrofuse for causing a break in a power lead, wherein the power lead has a predetermined breaking point along a length of the power lead, the fuse comprising:

an explosion chamber for triggering an explosion configured to cause a break in the power lead at the predetermined breaking point, the explosion chamber having first and second explosion chamber walls through which the power lead extends;

an isolating chamber having first and second isolating chamber walls through which the power lead extends, such that a fuse portion of the power lead extends between a first location of the first isolating chamber wall and a second location of the second isolating chamber wall, and wherein the fuse portion of the power lead includes the predetermined breaking point, and wherein the fuse portion of the power lead forms a wall that substantially isolates the isolating chamber from the explosion chamber prior to the explosion triggered in the explosion chamber; and an electrically insulating partition extending, from a bottom of the isolating chamber, toward the power lead, such that a distal end of the partition is spaced from the power lead;

wherein:

the power lead is configured to break into at least first and second parts at the predetermined breaking point by the explosion triggered in the explosion chamber, the first and second parts configured to bend at about the first and second locations, respectively, of the first and second explosion chamber walls, and the electrically insulating partition is configured to isolate the first and second parts from each other.

8. The pyrofuse according to claim 7, wherein:

the electrically insulating partition is positioned within the isolating chamber.

9. The pyrofuse according to claim 7, further comprising:

a magnet for providing a magnetic field configured to suppress formation of an arc between the first and second parts.

* * * * *